US007493783B2

(12) United States Patent
Hapke et al.

(10) Patent No.: US 7,493,783 B2
(45) Date of Patent: Feb. 24, 2009

(54) WASHING MACHINE LID LOCK WITH MAGNETIC LID SENSOR

(75) Inventors: Kenyon A. Hapke, Libertyville, IL (US); Michael Osvatic, Waukesha, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 11/513,878

(22) Filed: Aug. 31, 2006

(65) Prior Publication Data

US 2006/0288742 A1 Dec. 28, 2006

Related U.S. Application Data

(60) Division of application No. 10/609,252, filed on Jun. 27, 2003, which is a continuation-in-part of application No. 10/342,452, filed on Jan. 14, 2003, now abandoned.

(51) Int. Cl.
*D06F 37/42* (2006.01)
*D06F 39/14* (2006.01)

(52) U.S. Cl. ..... 68/12.26

(58) Field of Classification Search ..... 68/12.02, 68/12.26, 196; 134/57 DL, 58 DL; 292/DIG. 29
See application file for complete search history.

(56) References Cited

U.S. PATENT DOCUMENTS

| | | | | |
|---|---|---|---|---|
| 3,198,903 | A * | 8/1965 | Chafee, Jr. | 335/152 |
| 3,546,410 | A | 12/1970 | Brightenti | |
| 4,186,362 | A * | 1/1980 | Kondo et al. | 335/205 |
| 4,342,476 | A | 8/1982 | Brown et al. | |
| 4,717,794 | A | 1/1988 | Paul et al. | |
| 4,718,705 | A | 1/1988 | Case | |
| 5,038,587 | A | 8/1991 | Harmelink | |
| 5,323,628 | A | 6/1994 | Mori et al. | |
| 5,520,424 | A | 5/1996 | Hapke et al. | |
| 5,742,964 | A | 4/1998 | Choi | |
| 6,082,787 | A | 7/2000 | Chioffi et al. | |
| 6,400,996 | B1 * | 6/2002 | Hoffberg et al. | 700/83 |

FOREIGN PATENT DOCUMENTS

JP 403143498 A 6/1991

* cited by examiner

*Primary Examiner*—Joseph L Perrin
(74) *Attorney, Agent, or Firm*—Boyle Fredrickson, S.C.

(57) ABSTRACT

A magnetic lid closure sensor uses a magnet sensor element mounted within the washing machine housing below the closed lid. Flux directors conduct flux from a magnet in the lid to the magnet sensor. A lock mechanism employs a hook engaging an aperture in the lid so that opening of the lid does not impart a torque to the hook such as would disengage it, allowing the hook to be activated and deactivated with a simple bi-directional solenoid.

10 Claims, 5 Drawing Sheets

WASHING MACHINE LID LOCK WITH MAGNETIC LID SENSOR

CROSS-REFERENCE TO RELATED APPLICATIONS

This application is divisional application of Ser. No. 10/609,252 filed Jun. 27, 2003 which is a continuation-in-part of U.S. application Ser. No. 10/342,452 filed Jan. 14, 2003 now abandoned.

STATEMENT REGARDING FEDERALLY SPONSORED RESEARCH OR DEVELOPMENT

BACKGROUND OF THE INVENTION

The present invention relates to clothes washing machines and the like, and specifically, to a lid locking mechanism that may optionally include a magnetic lid sensor.

The spin cycle of a washing machine removes water centrifugally from wet clothes by spinning the clothes at high speed in a spin basket. In order to reduce the possibility of injury to the user during the spin cycle, it is known to use an electronically actuated lock for holding the washing machine lid in the closed position. U.S. Pat. Nos. 6,363,755; 5,823,017; and 5,520,424, assigned to the present assignee and hereby incorporated by reference, describe several locking mechanisms. Desirably, the locking mechanism minimizes projecting parts on the washing machine lid which might snag clothing or reduce access to the spin basket, and is simply integrated into the washing machine housing.

A signal indicating the state of the washing machine lid as opened or closed may be used to "wake" circuitry from a power saving mode, or to coordinate operation of the lid lock by ensuring the lid is closed before the lock in engaged. Such a signal may be provided by a switch communicating with the washing machine lid. Ideally such a switch could not be easily defeated, would operate reliably when used with other washing machine components with normal manufacturing tolerances, and would be resistant to contamination by water and dirt.

BRIEF SUMMARY OF THE INVENTION

The present invention provides a magnetic lid sensor for a washing machine lid supporting a magnet where the sensor includes a sensor housing mountable on the washing machine and a magnet sensor element held within the sensor housing displaced from a point of rest of the magnet when the washing machine lid is closed. At least one ferromagnetic flux director is held by the sensor housing having a first end near the point of rest of the magnet and having a second end near the magnet sensor to conduct flux there between.

Thus it is one object of the invention to provide a practical magnetic lid sensor for a washing machine. Magnetic flux directors allow the magnet sensor to be positioned in a protected position within the housing and still receive sufficient variation in magnetic flux to switch reliably and predictably with lid opening.

The magnet sensor may be a reed switch, the sensor housing may be non-magnetic and two ferromagnetic flux directors may be used to conduct the magnet flux in a loop between the magnet sensor and the magnet.

Thus it is another object of the invention to conduct sufficient magnetic flux to reliably activate a low cost magnet sensor.

The invention also provides a lid lock assembly which includes a cap sized to cover a mounting hole in the housing of a washing machine near a point of rest of the washing machine lid when the washing machine lid is closed. The cap may include at least one downwardly extending threaded hole. A housing of the lid lock may be located below the hole in the housing of the washing machine and may have a hole receiving an upwardly extending screw. The screw engages the downwardly extending threaded hole of the cap to hold the washing machine housing between an upper surface of the lock housing and a lower surface of the cap. The mounting hole is near the pivot point of a hook that may be used to lock the lid in the closed position.

Thus it is another object of the invention to provide a simple mounting system for a lid lock. Thus, it is another object of the invention to provide a simple mechanism for supporting a movable bolt that is robust against the force of a person attempting to open the lid.

The cap may include only a single downwardly extending threaded hole and the lock housing may include only a single mounting hole for attaching the lock housing to the washing machine.

It is thus another object of the invention to provide a lid lock that may be attached to the housing with a single screw. The positioning of the pivot of the hook to minimize torsion on the housing and to transfer forces on the lid to additional compression of the lock housing against the washing machine increases the robustness of this single screw mounting.

The downwardly extending hole in the cap may be blind to present a continuous upper cap surface.

Thus it is another object of the invention to minimize any holes that might accumulate or conduct water and dirt.

The cap may be an elastomeric plastic molded over a non-elastomeric plastic forming the threaded hole.

It is another object of the invention to provide both cushioning bumper and support for the lock housing in one structure. It is another object of the invention to provide a bumper that passes magnetic flux and that covers a hole in the washing machine housing sufficient in size to freely pass magnetic flux.

The present invention also provides generally a lid lock for a washing machine using a hook pivoting about an axis so as to move between a first locked position in which the opening of the closed lid is prevented by interference between the hook and an engagement surface on the lid and a second position in which the closed lid is free to open. An actuator may move the hook between the first position and the second position. A contact interface between the hook and the engagement surface is selected to prevent the force of opening the closed lid from moving the hook to the second position.

Thus it is another object of the invention to provide a locking mechanism with low friction that remains stably in the locked position without the application of a locking force.

The actuator may operate to alternatively move the hook toward and away from the locked position and may, for example, be a bi-directional solenoid.

Thus, it is another object of the invention to provide a lock that may be quickly locked and unlocked through electrical signals and yet does not require continuous consumption of electrical power or manual setting or resetting.

The engagement surface may move along a tangent line with first movement of the closed lid to open and the pivot axis of the hook may lie along a tangent line opposite the direction of movement of the engagement surface.

Thus it is another object of the invention to provide that opening force on the lid result in an upward force to the locking mechanism such as is absorbed against the housing of the washing machine.

The engagement surface in the lid may be an aperture and the hook may engage the aperture.

Thus it is another object of the invention to provide an extremely simple lid locking mechanism that does not require projections that might snag clothing or interfere with access to the spin basket.

The hook may include a central tooth engaging the aperture and flanking shoulders resting against sides of the aperture when the tooth is so engaged.

Thus it is another object of the invention to provide a simple structure for limiting the depth of engagement of the hook with the lid when the lid is in place.

The lock mechanism may include a spring communicating with the hook for urging the hook toward the first position when the hook is proximate to the first position and urging the hook toward the second position when the hook is proximate to the second position. A contact set may communicate with the hook to provide a switch output indicating when the hook is at the first position as distinguished from when the hook is at the second position.

Thus it is another object of the invention to create a bi-stable positioning of the hook such as simplifies determination of the hook state using a contact set and which prevents inadvertent movement of the hook under vibration and the like.

The contact set may provide a closed circuit between a first and second terminal when the hook is in the first position in an open circuit between the first and second terminals when the hook is in the second position.

It is thus another object of the invention to provide certainty in any signal indicating the lid is locked in the presence of possible wiring failure.

The contact set may include a sliding contact moving laterally over a stationary contact and the stationary contact may be positioned next to a cam surface engaging the sliding contact with over travel of the sliding contact to lift the sliding contact transversely away from the stationary contact.

Thus it is another object of the invention to provide a contact set capable of detecting small motions while using large area contacts.

These particular objects and advantages may apply to only some embodiments falling within the claims and thus do not define the scope of the invention.

DETAILED DESCRIPTION OF THE PREFERRED EMBODIMENT

Figure 1:
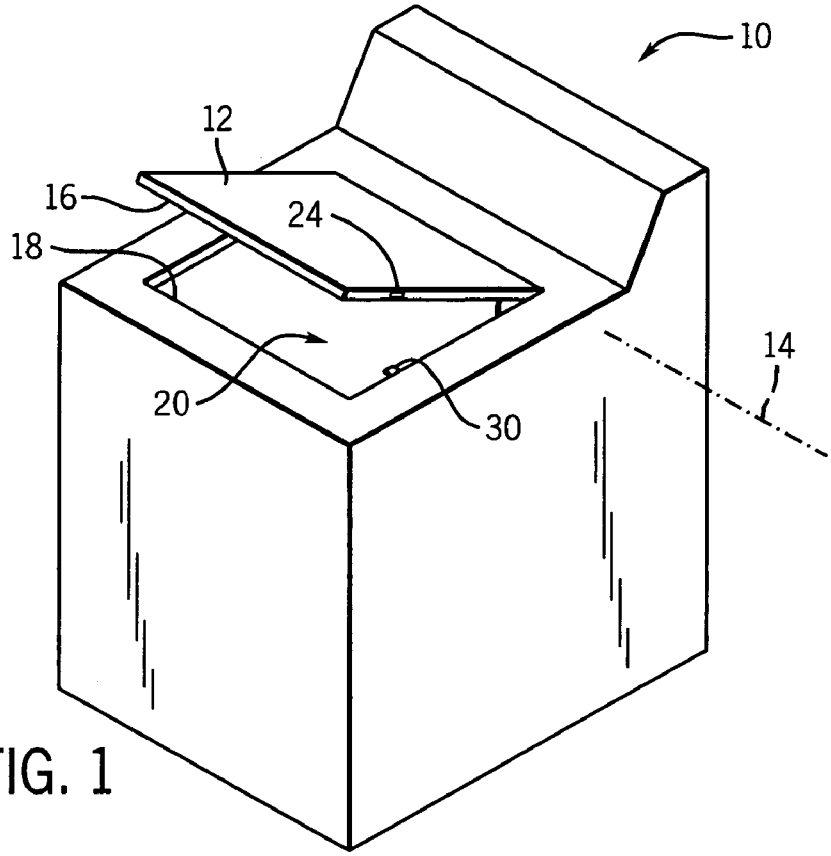
FIG. 1 is a perspective view of a top loading washing machine suitable for use with the present invention showing a strike formed from a side of an opened lid of the washing machine and a bolt for engaging the same when the lid is closed.

Referring now to FIG. 1, a top loading washing machine 10 suitable for use with the present invention includes a lid 12 opening upward about a horizontal lid hinge axis 14. The lid hinge axis 14 is positioned near the top rear edge of the washing machine 10 so that a front edge 16 of the lid 12 may raise and lower to expose and cover an opening 20 through which clothing may be inserted into the spin basket. A front-loading washing machine (not shown) is also suitable for use with the present invention as will be apparent to those of ordinary skill in the art.

Figure 2:
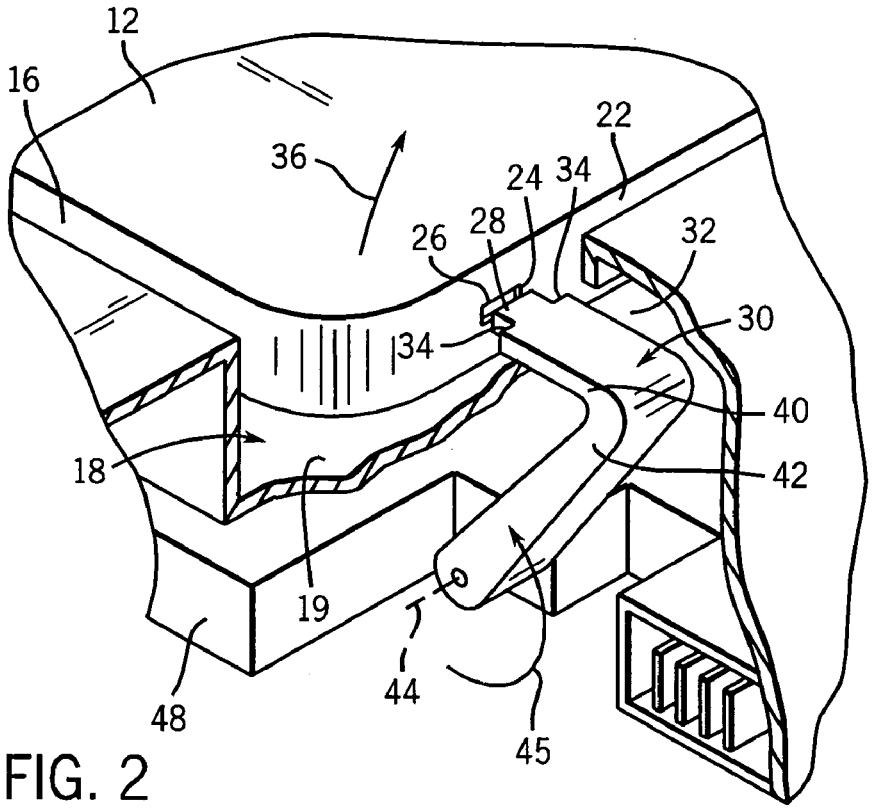
FIG. 2 is a fragmentary cutaway of the portion of the lid and washing machine near the bolt of FIG. 1 showing support of a locking mechanism beneath a lid well.

Referring now to FIG. 2, when the lid 12 is in the closed position, it sits within a lid well 18 having vertical walls 32 surrounding vertical walls 22 of the lid 12 and having a horizontal ledge 19 on which the lower surface of the lid 12 may rest. A vertical wall 22 of the lid 12 near a front edge 16 of the lid 12 provides a strike plate 24 having a bolt hole 26.

Figure 3:
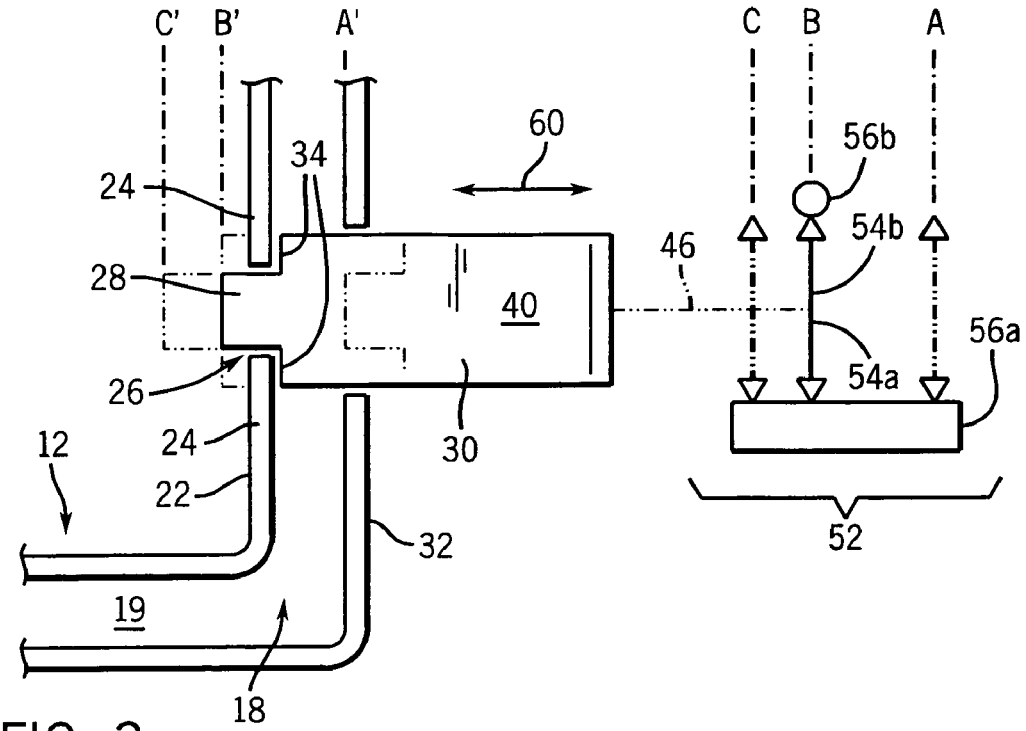
FIG. 3 is a simplified top plan view of the bolt of FIG. 2 extending through a wall of the lid well to engage a strike of the lid and illustrating a retraction position, engagement position, and extension position of the bolt and further showing corresponding states of an electrical switch connected to the bolt to provide an indication of bolt position.

Referring also to FIG. 3, the bolt hole 26 is sized to receive a tooth portion 28 of a lateral extension 40 of a hook 30 passing horizontally through a vertical wall 32 of the lid well 18 opposite the strike plate 24 when the lid 12 is closed. When the tooth portion 28 is engaged in the bolt hole 26, the lid 12 may not be raised vertically as indicated by arrow 36 as a result of the lower edge of the bolt hole 26 interfering with a lower edge of the tooth portion 28.

The tooth portion 28 extends from shoulders 34 which flank the tooth portion 28 and are sized to be larger than the bolt hole 26 so that the shoulders 34 may not pass through the bolt hole 26. When the lid 12 is closed, the shoulders 34 limit the amount that the hook 30 may extend through the bolt hole 26 and thus limit the length of extension of the hook 30 from the vertical wall 32 of the lid well 18. When the lid 12 is open, however, the shoulders 34 may move further in extension as will be described.

Figure 4:
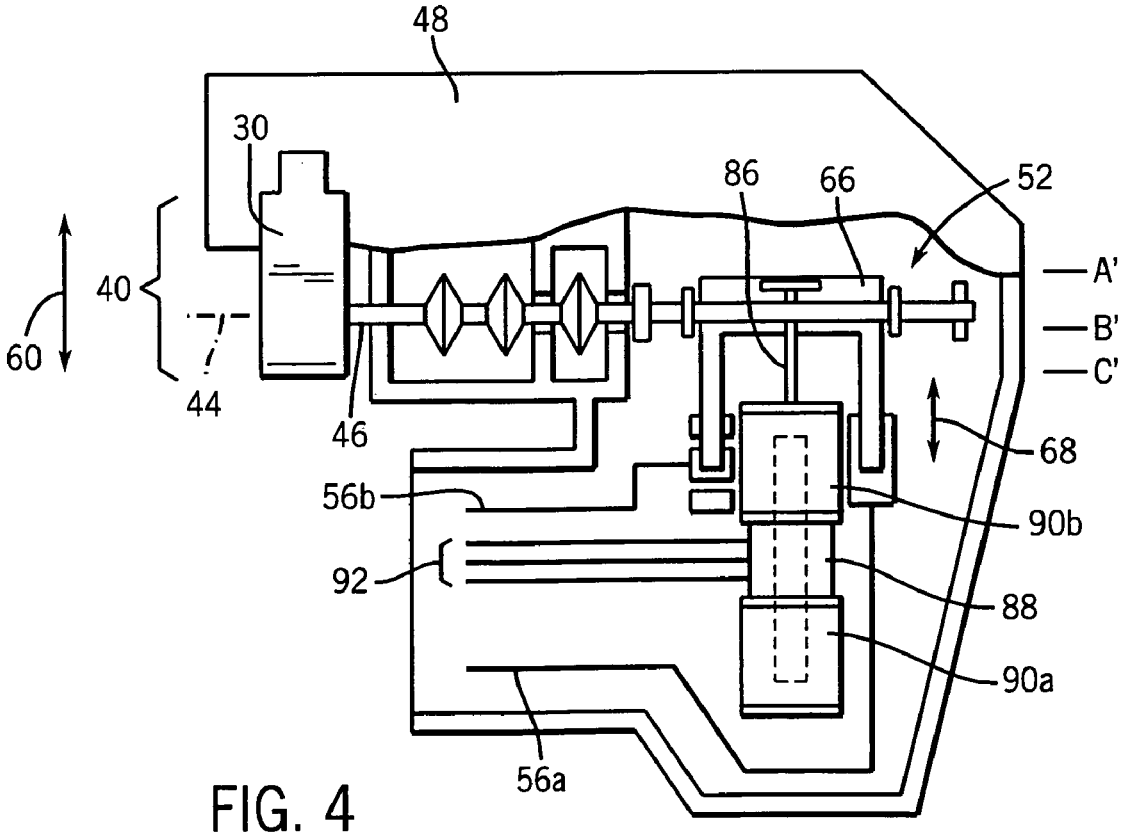
FIG. 4 is a top plan view of the locking mechanism of FIG. 2 in partial cutaway to show a rotating shaft connecting the bolt of FIG. 3 to a contact assembly and a bi-directional actuator.

Referring also to FIG. 4, the lateral extension 40 of the hook 30 is connected to a radial portion 42 to form a hook pivoting, as indicated by arrow 45, about a rotation axis 44 where the hook is attached to an axle 46. The axle 46 is supported for rotation within a housing 48 of a locking mechanism positioned beneath the lid well 18.

Referring now to FIG. 3, as will be discussed in detail below, the hook 30 communicates via the axle 46 (shown schematically in FIG. 3) with a contact set 52. The contact set 52 provides a three position switch in which two poles 54*a* and 54*b* connecting to respective terminals 56*a* and 56*b* in a center position (B) and disconnect from terminals 56*b* in left and right positions (C) and (A), respectively. Where the poles 54*a* and 54*b* are joined to each other so that in position (B), a closed circuit is presented across terminals 56*a* and 56*b* and in positions (A) and (C), an open circuit is presented across terminals 56*a* and 56*b*.

These three switch positions (A), (B), and (C) correspond to three positions (A'), (B'), and (C') of the hook 30. The first hook position (A') is where the forward tooth portion 28 of the hook 30 remains retracted behind the vertical wall 32 of the lid well 18. The hook 30 may be in this position prior to the hook 30 being actuated or if the hook has been actuated, but was obstructed or jammed, or if the actuator fails. In this position, an open circuit is presented across terminals 56*a* and 56*b*.

The second hook position (B') is where tooth portion 28 of the hook 30 extends through the bolt hole 26 and the shoulders 34 of the hook abut strike plate 24. The hook 30 will be in this position if the lid 12 is closed and the hook 30 is actuated. In this position, the lid 12 is locked and a closed circuit is presented across terminals 56*a* and 56*b*.

The third hook position (C') is where tooth portion 28 and the shoulders 34 of the hook 30 extends past the position normally occupied by the strike plate 24 as may occur if the lid 12 is open at the time of actuation of the hook 30. In this position, an open circuit is presented across terminals 56*a* and 56*b*.

Thus, it will be understood that a proper locking of the lid by the hook 30 is indicated by a closed circuit across terminals 56*a* and 56*b*, whereas an open circuit across these terminals 56*a* and 56*b*, indicates either an obstruction of the hook 30 at the aperture in the vertical wall 32 or failure of the actuator or over-extension indicating that the lid 12 was not closed at the time of locking or an electrical break in the wiring communicating with the terminals 56*a* and 56*b*. Any of these latter open circuit conditions suggest that access may be had to the opening 20 leading to the spin basket of the washing machine and may be used to override the spin cycle, stopping it or preventing it from starting.

Figure 5:
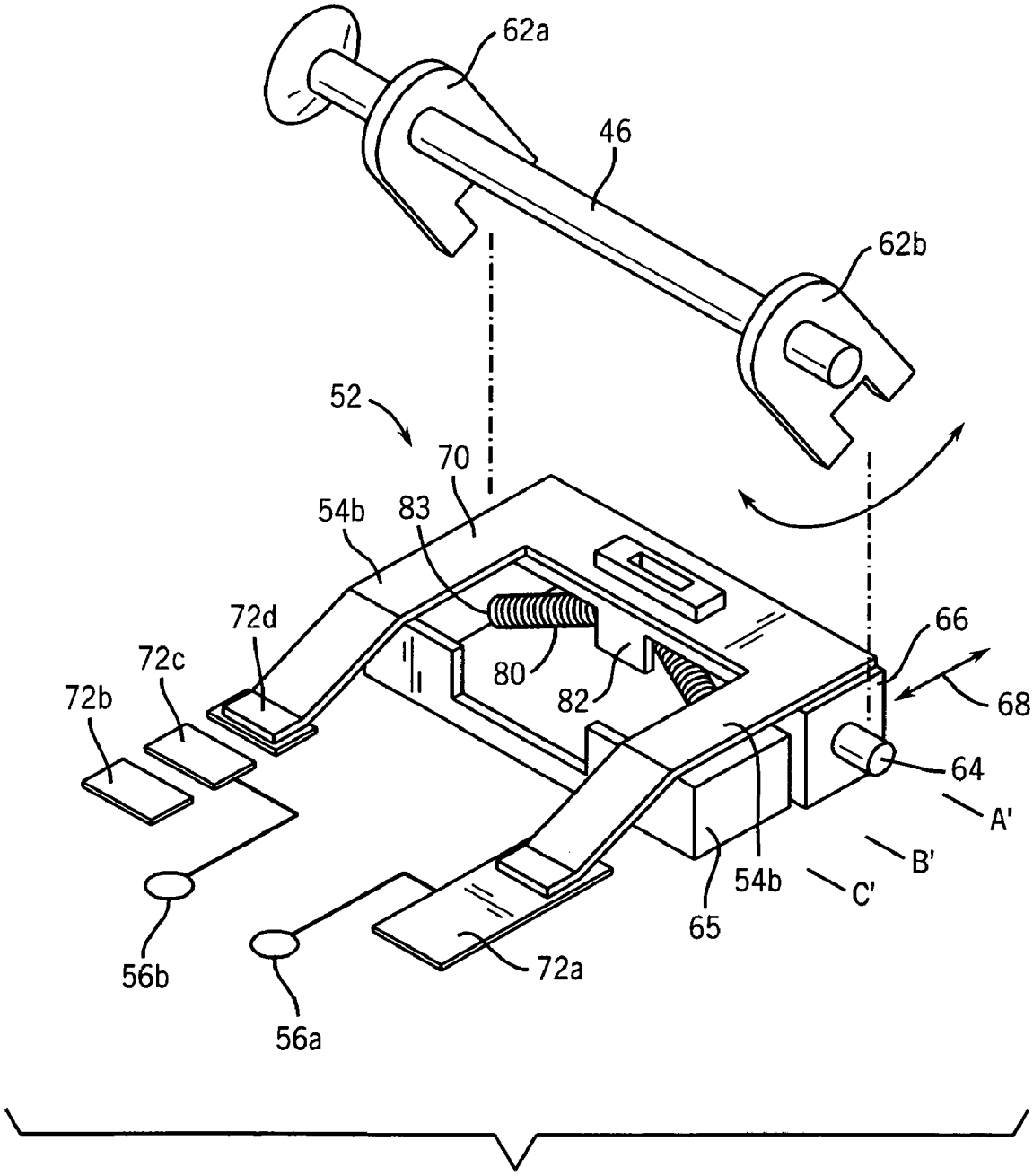
FIG. 5 is a perspective view of the contact assembly of FIG. 4 such as implements the switch of FIG. 3 and showing an overcenter spring that causes the bolt to be bi-stable in the extension and retraction position when the lid is open, and the engagement and retraction position when the lid is closed.

Referring now to FIGS. 4 and 5, motion of the hook 30 along the lateral axis 60 causes rotation of the axle 46 within the housing 48. The axle 46 includes two downward extending forks 62*a* and 62*b* that engage tabs 64 on a carriage 66. In this way, rotation of the axle 46 with motion of the hook 30 along the lateral axis causes motion of the carriage 66 on a carriage track 65 along lateral axis 68 parallel to lateral axis 60.

The carriage 66 supports a horseshoe conductor 70 fitted to the top of the carriage 66 having laterally extending arms that form throws 54*a* and 54*b*. The arm forming throw 54*a* of the horseshoe conductor 70 extends along the lateral axis 68 over throw pads 72*a*. The arm forming throw 54*b* of the horseshoe conductor 70 extends along the lateral axis 68 over throw pads 72*b*-72*d*.

Throw pad 72*a* is a conductive metallic plate connected to terminal 56*a* and extending a distance along the lateral axis 68 sufficient so that it maintains contact with pole 54*a* for the entire range of motion of the carriage 66. Throw pad 72*c* is a conductive metallic plate connected to terminal 56*b* and contacting pole 54*b* only when the hook 30 is in the second hook position (B). Throw pads 72*b* and 72*d* are insulators that support the pole 54*b* when the hook 30 is in the hook positions (A) and (C), respectively, providing no electrical connection to terminal 56*b*.

A helical compression spring 80 is girdled at a midpoint along its length by tabs 82 on the under side of the carriage 66. The ends of the helical compression spring 80 are held by retaining posts 83 on opposed inside walls of carriage track 65. The helical compression spring 80 in a relaxed state is longer than the separation of the retaining posts on the inside walls of the carriage track 65 so as to make the carriage 66 bi-stable in positions (A') and (C') corresponding to hook positions (A) and (C). Bi-stability means that the carriage 66 tends to move toward position (A') when the carriage is near position (A'), and that the carriage 66 tends to move toward position (C') when the carriage is near position (C'). When the carriage is in position (B'), it is also urged toward position (C').

Accordingly, referring again to FIG. 3, the hook 30 is stable in positions (A) and (C) when the lid 12 is open and is stable in positions (A) and (B) when the lid 12 is closed, the stability at position (B) being provided by the blocking action of the strike plate 24.

The carriage 66 is attached to an arm 86 extending from a metal slug 88 held within solenoids 90*a* and 90*b*. The solenoids 90*a* and 90*b* may be alternatively energized through terminals 92 so that when solenoid 90*b* is energized, the carriage 66 is pushed toward position (A'), and when solenoid 90*a* is energized, the solenoid is pushed toward position (C') and hence also (B').

In this way, the lid 12 may be alternately locked or unlocked by electrical signals through terminals 92. Upon ceasing of the signals through terminals 92, the hook 30 is held in its current state by the bi-stable mechanism of spring 80.

Figure 6:
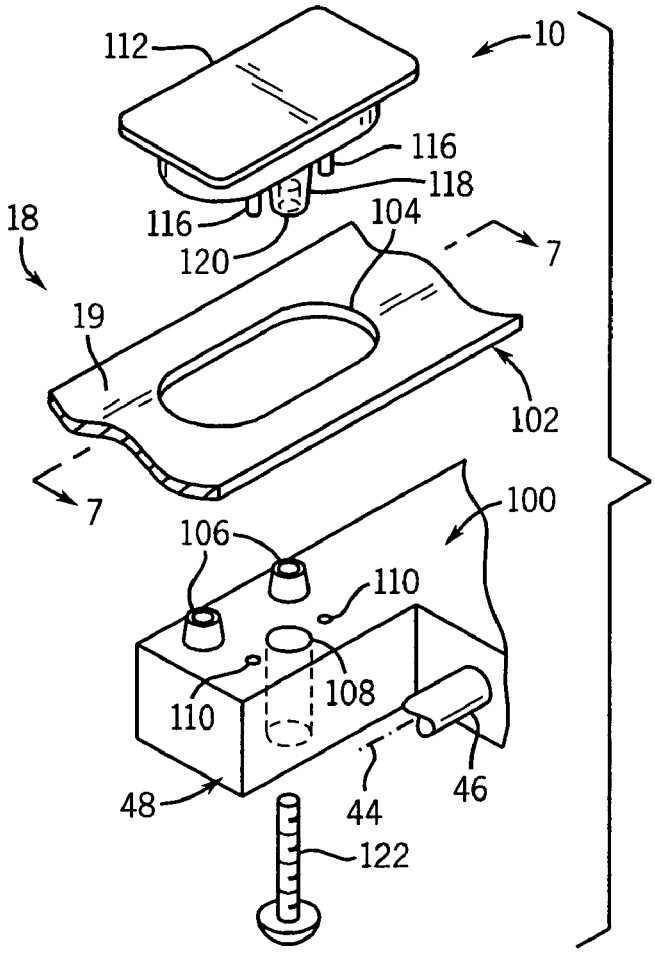
FIG. 6 is a perspective, exploded, fragmentary view of a portion of the housing of FIGS. 2 and 4 showing mounting of the locking mechanism to the washing machine.

Referring now to FIG. 6, the housing 48 of the lid lock, near the axle 46, has an upper surface 100 having a through-hole 108 passing vertically through the housing 48, two blind registration holes 110 flanking the through hole 108, and two upwardly extending posts 106 displaced to one side of the line defined by the through-hole 108 and registration holes 110, the posts 106 being separated by approximately the spacing to the registration holes 110. The posts 106 include vertically extending metal slugs (not shown in FIG. 6) providing flux directors as will be described.

The upper surface 100 of the housing 48 fits against a lower surface 102 of the horizontal ledge 19 of the lid well 18. A hole 104 may be cut in the horizontal ledge 19 to expose on the upper surface 100 the upwardly extending posts 106, the through-hole 108, and the two registration holes 110.

A cap 112 placed on the hole 104 extends partially therethrough to receive the posts 106 within a cavity of the cap 112. Registration pins 116 and a boss 118 extend downwardly from the lower surface of the cap 112 to be received within the registration holes 110 and the through-hole 108 respectively.

Figure 7:
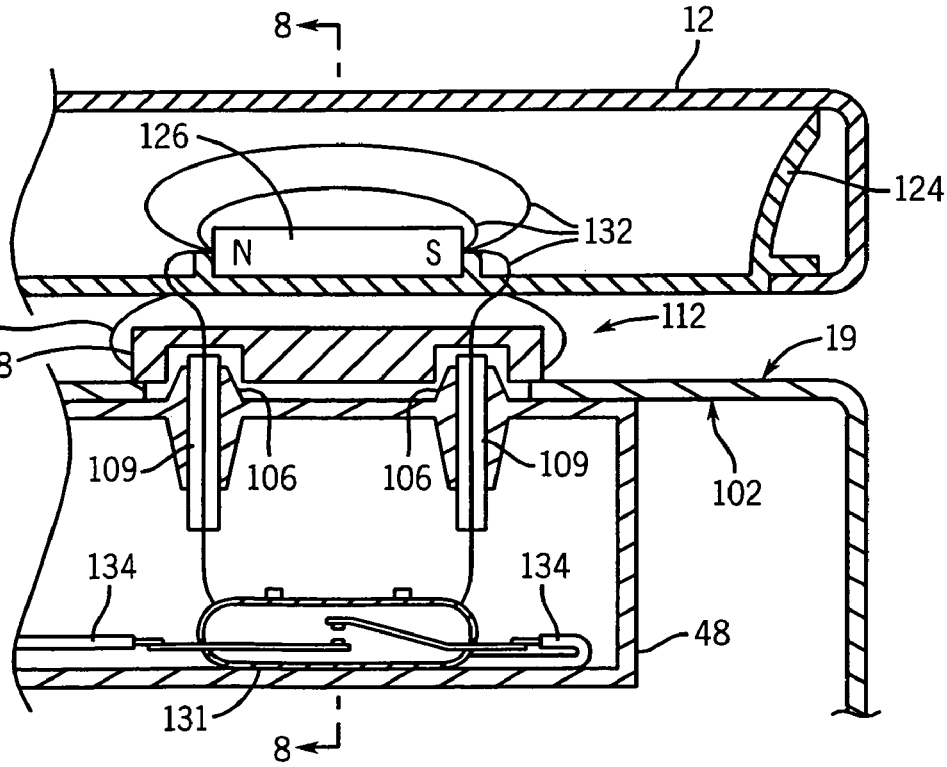
FIG. 7 is a cross-sectional view taken along line 7-7 of FIG. 6 showing flux directors for conducting magnetic flux from a magnet mounted in the lid of the washing machine into the washing machine housing to a magnet sensor.

The boss 118 has a downwardly open threaded hole 120. A machine screw 122 may be inserted upwardly through the through hole 108 from the bottom of the housing 48 to be received by the threaded hole 120. Tightening of the threaded fastener 122 draws the housing 48 and cap 112 together sandwiching the horizontal ledge 19 there between and fixing the housing 48 to the washing machine 10. Referring also to FIG. 7, the cap 112 may include a core 128 of rigid thermoplastic over-molded with a soft elastomer 130 to provide an outward cushioning for the lid 12 and yet a firm purchase for the threaded fastener 122.

The lid 12 of the washing machine 10 may be constructed of a shell of enameled steel having a concave lower surface receiving a plastic liner 124 providing a lower wall to the lid 12. The liner 124 holds a bar magnet 126 on its inner surface where the bar magnet 126 may be shielded from exposure to water and the like. The bar magnet 126 is positioned so that when the lid 12 is closed against the horizontal ledge 19, the bar magnet 126 rests above the cap 112.

Referring to FIGS. 6 and 7, the hole 104 in the horizontal ledge 19 of the washing machine 10 is sized to remove steel from a path between the magnet 126 and a reed switch 131 held in the housing 48 of the lid lock. The separation of the posts 106 extending up through the hole 104 (and thus the separation of the contained flux directors 109) is set to be substantially the same as the length of the bar magnet 126 extending between and above them and comparable to a length of the magnetic reed switch 131 positioned at the lower ends of the flux directors 109.

When the lid 12 is closed, magnetic flux 132 is directed by the flux directors 109 to the reed switch 131 forming a complete magnetic circuit therewith. When the lid 12 is opened, the magnetic flux circuit is broken. The flux directors 109 allow displacement of the reed switch 131 deeper into the housing of the washing machine while still allowing the reed switch 131 to be activated with a magnet of modest size. The flux directors 109 also may serve to concentrate the magnetic flux 132 producing a better defined switching point as the lid is opened.

The reed switch 131 may communicate with conductors 134 that connect with pins added to pins 56 and 92 as have been described to provide a lid closed signal for activation of other circuitry associated with the washing machine.

Figure 8:
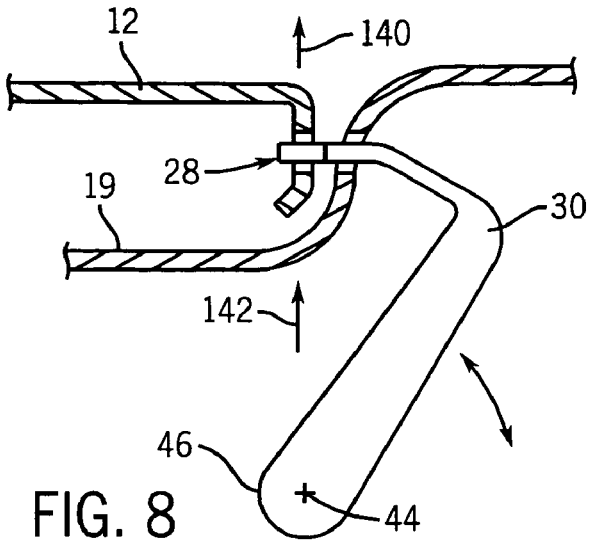
FIG. 8 is a cross-sectional view taken along line 8-8 of FIG. 7 showing the interface between the hook and lid and the location of the pivot point of the hook such as prevents movement of the hook by forces generated by attempted opening of the lid.

Referring now to FIG. 8, the rotation axis 44 of axle 46 may be located directly below a point of engagement (contact interface) of the hook 30 and the lid 12. As so located, upward motion of the lid 12 initially along tangent 140 produces an upward vector 142 on axle 46 creating minimal torque on the housing 48 and mostly upward force against the lower surface of the ledge 19 augmenting that provided by screw 122 (shown in FIG. 6).

In addition, the contact interface (occurring between a lower surface of the tooth 28 of the hook 30 and the lower surface of the bolt hole 26) is such as to impart no torque or a slight engaging torque (counterclockwise in FIG. 8) to the hook 30 about axis 44 with upward motion of the lid 12. This is accomplished simply by ensuring that the slope at the contact interface is zero or slightly canted inward (toward the lid 12) with respect to upward vector 142. This design greatly simplifies construction of the lock mechanism and is particularly well suited for the bi-directional solenoid 90 described above because it allows the lock to function without continued activation of the solenoids 90*a* or 90*b*. The slight bistability added by the spring 80 described with respect to the contact set of FIG. 5 ensures that unintended movement with vibration and the like does not occur.

Figure 9:
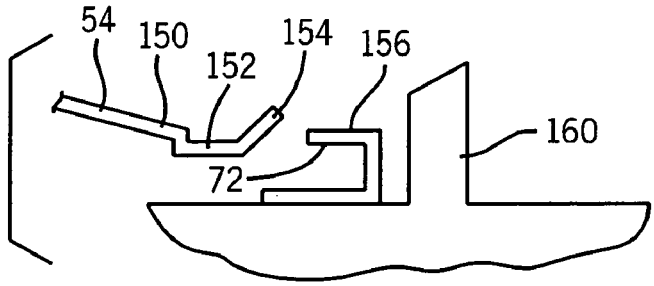
FIGS. 9 through 11 are side elevational views of one contact of the switch of FIG. 5 showing the use of a cam surface for lifting the contact upon overtravel.
Figure 10:
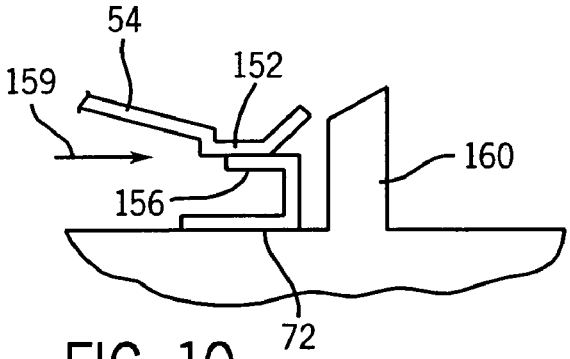
Figure 11:
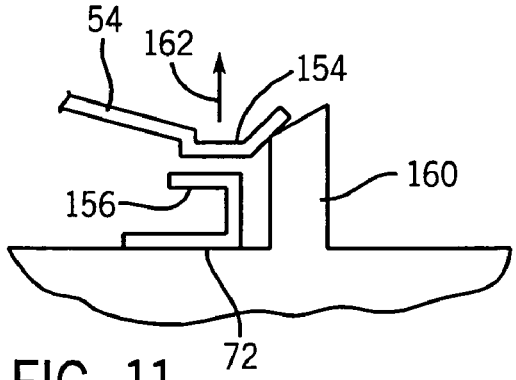

Referring now to FIG. 9, sliding contact 54, described above with respect to FIG. 5, may include a downwardly sloping spring portion 150 terminating in a substantially horizontal contact surface 152 followed by an upwardly sloping ramp portion 154. As shown in FIG. 2, when the switch is in position (A), the horizontal contact surface 152 will be suspended in air or contacting an insulator.

As shown in FIG. 2, when the switch is in position (B), the horizontal contact surface 152 will abut a corresponding horizontal contact surface 156 of stationary contact 72. The area of the contact surfaces 152 and 156 may be large enough to provide desirable low contact resistance and suitable current carrying capability.

Normally separation of the contact surfaces 152 and 156 with over travel would require over travel equal to the length of combined lateral extent of contact surfaces 156 and 152 would be required for full disengagement of the contacts 54 and 72. In order to provide greater precision in detect angular changes in the hook 30 (tied to the contacts 54) a cam surface 160 is located immediately following stationary contact 72 and formed of the material of the housing 48 also supporting stationary contact 72. The cam surface 160 interacts with the ramp portion 154 of the sliding contact 54 moving the contacts 54 and 72 in separation in a transverse direction 162 perpendicular to the lateral sliding direction 159. Thus a slight additional over travel motion completely separates the contacts without the need for them to slide laterally entirely out of engagement.

It is specifically intended that the present invention not be limited to the embodiments and illustrations contained herein, but include modified forms of those embodiments including portions of the embodiments and combinations of elements of different embodiments as come within the scope of the following claims.

We claim:

1. A magnetic lid sensor for a washing machine lid supporting a magnet, the sensor comprising:

a sensor housing mountable on the washing machine within a metallic housing of the washing machine;

a magnet sensor held within the sensor housing adapted to be displaced from a point of rest of the magnet when the washing machine lid is closed and the sensor housing is mounted on the washing machine such that the magnet sensor within the magnet sensor housing is displaced from the metallic housing of the washing machine; and at least one ferromagnetic flux director fixed against movement with respect to the sensor housing and held by the sensor housing such that the flux director extends into or through at least one of the sensor housing and metallic housing to position a first end near the point of rest of the magnet and a second end held near the magnetic sensor within the metallic housing of the washing machine to conduct flux between the magnet and magnet sensor when the sensor housing is mounted on the washing machine;

wherein the ferromagnetic flux director is substantially unmagnetized.

2. The magnetic lid sensor of claim 1 wherein the sensor housing is a non-magnetic material.

3. The magnetic lid sensor of claim 1 wherein the magnet sensor is a reed switch.

4. The magnetic lid sensor of claim 1 including two ferromagnetic flux directors each having first and second ends positioned with their first ends flanking the magnet and their second ends flanking the magnet sensor to conduct magnetic flux in a loop between the magnet sensor and the magnet.

5. The magnetic lid sensor of claim 1 further including:

a cap sized to cover a hole in the housing of a washing machine near a point of rest of the washing machine lid when the washing machine lid is closed, the cap including at least one downwardly extending hole;

wherein the sensor housing has at least one mounting hole conducting a shaft of an upwardly extending screw receivable within the downwardly extending hole of the cap to compress the washing machine housing between an upper surface of the sensor housing and a lower surface of the cap when the screw is tightened.

6. The magnetic lid sensor of claim 5 wherein the sensor housing further supports a hook pivotable about an axis at a pivot point proximate to the mounting hole, the hook pivoting between a first position in which opening of the closed washing machine lid is prevented by interference between the hook and an engagement surface on the washing machine lid, and a second position in which the closed washing machine lid is free to open.

7. The lid lock assembly of claim 5 wherein the downwardly extending hole is blind to present a continuous upper cap surface.

8. The lid lock assembly of claim 5 wherein the cap includes only a single downwardly extending hole and the sensor housing includes only a single mounting hole for attaching the lock housing to the washing machine.

9. The lid lock assembly of claim 5 wherein the cap is an elastomeric plastic over a non-elastomeric plastic base, the latter supporting the downwardly extending hole.

10. A magnetic lid sensor for a washing machine lid supporting a magnet, the sensor comprising:

a sensor housing mountable on the washing machine;

a magnet sensor held within the sensor housing adapted to be displaced from a point of rest of the magnet and within a ferromagnetic housing of the washing machine when the washing machine lid is closed and the sensor housing is mounted on the washing machine; and at least one ferromagnetic flux director held by the sensor housing such that the flux director extends into or through at least one of the sensor housing and metallic housing to position a first end near the point of rest of the magnet and a second end held near the magnetic sensor to align (i) the point of rest of the magnet, (ii) the ferromagnetic flux director, and (iii) the magnet sensor with each other for conducting flux between the magnet and magnet sensor when the sensor housing is mounted on the washing machine, wherein the magnet is generally oriented along an axis extending between a north to south pole of the magnet and a longest dimension of the ferromagnetic flux director extends perpendicular to the axis of the magnet.

* * * * *